United States Patent [19]

Bearden, Jr. et al.

[11] 3,976,559

[45] Aug. 24, 1976

[54] COMBINED CATALYTIC AND ALKALI METAL HYDRODESULFURIZATION AND CONVERSION PROCESS

[75] Inventors: Roby Bearden, Jr.; Glen Porter Hamner, both of Baton Rouge, La.

[73] Assignee: Exxon Research and Engineering Company, Linden, N.J.

[22] Filed: Apr. 28, 1975

[21] Appl. No.: 571,918

[52] U.S. Cl. ..... 208/89; 208/208 M; 208/210

[51] Int. Cl.[2] ..... C10G 23/02

[58] Field of Search ..... 208/89, 210, 107, 142, 208/208 M

[56] References Cited

UNITED STATES PATENTS

| | | | |
|---|---|---|---|
| 2,034,818 | 3/1936 | Loughrey | 208/142 |
| 2,773,011 | 12/1956 | Haensel | 208/89 |
| 3,745,109 | 7/1973 | Heredy et al. | 208/107 |
| 3,787,315 | 1/1974 | Bearden, Jr. et al. | 208/208 M |
| 3,788,978 | 1/1974 | Bearden, Jr. et al. | 208/208 M |

*Primary Examiner*—G. J. Crasanakis
*Attorney, Agent, or Firm*—J. Simon; E. M. Corcoran

[57] ABSTRACT

A process for the combined hydrodesulfurization and hydroconversion of certain heavy hydrocarbon feedstocks is disclosed. Specifically, asphaltene-containing feedstocks, such as residua feedstocks, are initially contacted with a hydrodesulfurization catalyst which selectively avoids the conversion of the asphaltene agglomerates and metal-containing compounds therein, so that said feedstock is at least partially desulfurized, and then is contacted with an alkali metal in a conversion zone at elevated temperatures and in the presence of added hydrogen so that said feedstock is both further desulfurized and hydroconverted, preferably so that at least about 50 percent of the 1050°F+ portion of the feedstock is converted to lower boiling products. In this manner the catalyst is maintained for long periods, while at the same time advantage is taken of the ability of the alkali metal desulfurization agent to both desulfurize and upgrade the hydrocarbon feedstock by the hydroconversion of the higher boiling components thereof.

19 Claims, 1 Drawing Figure

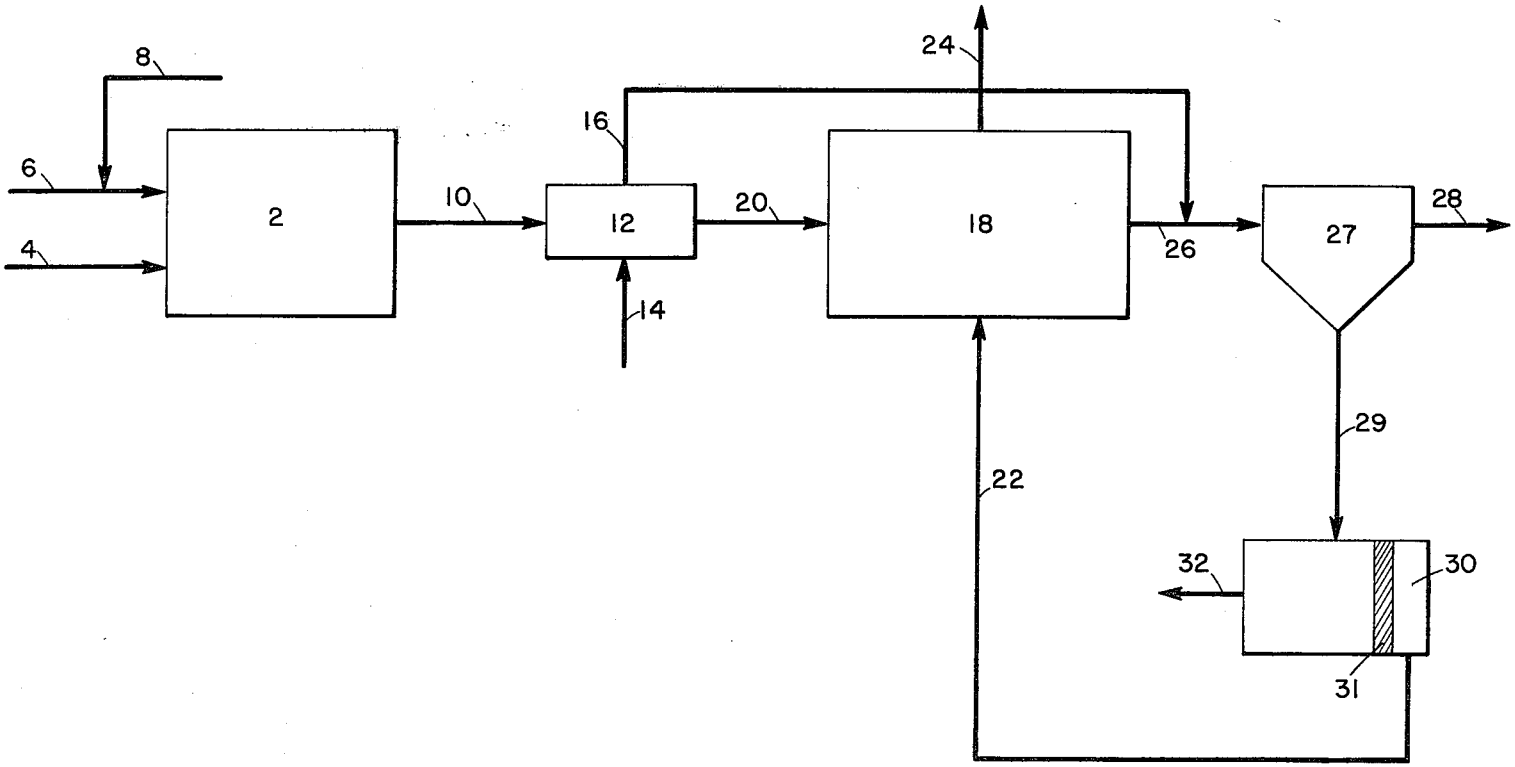
2
4
6
8
10
12
14
16
18
20
22
24
26
27
28
29
30
31
32

COMBINED CATALYTIC AND ALKALI METAL HYDRODESULFURIZATION AND CONVERSION PROCESS

FIELD OF THE INVENTION

The present invention relates to an improved process for the combined hydrodesulfurization and hydroconversion of a sulfur-containing hydrocarbon feedstock. More particularly, the present invention relates to a process for the combined catalytic hydrodesulfurization of the lower-boiling components of an asphaltene-containing hydrocarbon feedstock, and the combined hydrodesulfurization and hydroconversion thereof in the presence of a desulfurization agent. Still more particularly, the present invention relates to improved processes for obtaining the catalytic hydrodesulfurization of asphaltene-containing feedstock without the rapid deactivation of the catalyst so employed. Still more particularly, the present invention relates to a process for the deep desulfurization of a heavy hydrocarbon feedstock with a desulfurization agent, particularly whereby at least about 80 percent of the sulfur in such feedstock is removed. Still more particularly, the present invention relates to an integrated process for the catalytic and non-catalytic desulfurization of a heavy hydrocarbon feedstock, including the regeneration of the desulfurization agent employed in the non-catalytic portion thereof.

DESCRIPTION OF THE PRIOR ART

Because of the large amounts of sulfur-bearing fuel oils which are currently being employed as raw materials in the petroleum refining industry, the problems of air pollution, particularly with regard to sulfur oxide emissions, have become of increasing concern. This has become particularly true with regard to several high sulfur content feedstocks, particularly those including high-boiling asphaltene components. For these reasons various methods for the removal of sulfur from these feedstocks have been the subject of intensive research efforts by this industry. At present, the most practical commercial means of desulfurizing such fuel oils is the catalytic hydrogenation of sulfur-containing molecules and petroleum hydrocarbon feeds in order to effect the removal, as hydrogen sulfide, of the sulfur-containing molecules therein. These processes generally require relatively high hydrogen pressures, generally ranging from about 700 to 3000 psig, and elevated temperatures generally ranging from 650° to 800°F, depending upon the feedstock employed and the degree of desulfurization required.

Such catalytic processes are generally quite efficient for the desulfurization of distillate-type feedstocks, but become of increasing complexity and expense, and decreasing efficiency, as increasingly heavier feedstocks, such as whole or topped crudes and residua are employed. This is particularly true with regard to asphaltene-containing feedstocks, including residuum feedstocks, since such feedstocks are often contaminated with heavy metals, such as nickel, vanadium and iron, as well as with the asphaltenes themselves, which tend to deposit on the catalyst and deactivate same. Furthermore, a large portion of the sulfur content in these feeds is generally contained in the higher molecular weight molecules, which can only be broken down under the more severe operating conditions, and which generally cannot diffuse through the catalyst pores.

The more severe operating conditions thus tend to degrade the feedstock due to thermal cracking, while catalyst deactivation is accelerated by the formation of coke deposits thereon.

As an alternative desulfurization process, molten dispersions of various alkali metals, such as sodium, and alkali metal alloys, such as sodium/lead have been employed as desulfurization agents. Basically, these processes have involved the contacting of a hydrocarbon fraction with such an alkali metal or sodium dispersion, wherein the sodium reacts with the sulfur to form dispersed sodium sulfide. Such a process is thus taught in U.S. Pat. No. 1,938,672 which employs such alkali metals in a molten state. These processes, however, have suffered from several distinct disadvantages. Specifically, these have included relatively low desulfurization efficiency, due partially to the formation of substantial amounts of organo-sodium salts, the tendency to form increased concentrations of high molecular weight polymeric components, such as asphaltenes, and the failure to adequately remove metal contaminants from the oil. In addition, it has, in the past, been exceedingly difficult to resolve the resultant alkali metal salts-oil mixtures and regenerate alkali metal therefrom. Furthermore, these processes have never been capable of achieving both significant desulfurization and the hydroconversion of the feedstocks being so treated. Recently, however, U.S. Pat. No. 3,788,978 assigned to Exxon Research & Engineering Company, the assignee of the present invention, disclosed a process which included means for resolving the desulfurized oil-alkali metal salt mixtures. Furthermore, U.S. Pat. No. 3,878,315, also assigned to Exxon Research and Engineering Company, disclosed that such alkali metal desulfurization, when carried out in the presence of low pressure hydrogen, resulted in improved efficiency, whereby less sodium was required in order to remove given amounts of sulfur. Furthermore, improved demetallization, and elimination of sludge formation was obtained. Again, however, these processes do not achieve simultaneous desulfurization and hydroconversion of the hydrocarbon feedstocks employed.

In several patent applications filed concurrently with this application, including Ser. No. 571,903 filed Apr. 28, 1975 and Ser. No. 571,917 filed Apr. 28, 1975, it has now been discovered that at certain specific operating conditions, the latter processes employing specific desulfurization agents, such as alkali metals, may be carried out to effect both the desulfurization and hydroconversion of the feedstocks employed therein. Specifically, as shown in Ser. No. 571,903, it is possible to obtain the conversion of at least about 50 percent of the 1050°F+ portion of these feedstocks, while simultaneously desulfurizing same.

SUMMARY OF THE INVENTION

In accordance with the present invention, it has now been discovered that various heavy hydrocarbon fractions, particularly asphaltene-containing hydrocarbon feedstocks, may be subjected to high degrees of hydrodesulfurization, as well as hydroconversion, in an efficient combined catalytic and non-catalytic hydrodesulfurization process. Specifically, such hydrocarbon feedstocks, including various residua, are initially contacted with a hydrodesulfurization catalyst which is effective for the selective hydrodesulfurization of the lower-boiling components thereof. The hydrodesulfurization catalyst employed, in combination with the specific hydrodesulfurization conditions maintained in the conversion zone, is thus designed to avoid the conversion of the asphaltene components thereof, specifically while between about 30 and 80 percent of the sulfur in such feedstocks is removed therein. Subsequently, the products of this catalytic hydrodesulfurization step, which are now at least partially desulfurized, are then contacted with an alkali metal in a conversion zone, at elevated temperatures and in the presence of added hydrogen, so that at least about 90 percent of the sulfur originally contained in the initial hydrocarbon feedstocks is now removed therefrom, and further so that at least about 50 percent of the 1050°F+ portion of said feedstock is converted to lower-boiling products. In this manner, the catalyst life expectancy of the hydrodesulfurization catalyst is extended by a considerable degree, while at the same time the hydrodesulfurization requirements of the relatively more expensive alkali metal desulfurization agent is held to a minimum, whereby the higher boiling components, particularly the asphaltenes, are desulfurized and subjected to hydroconversion therein.

The selective hydrodesulfurization catalyst which is thus employed in the initial step of the present process thus comprises at least one metallic hydrogenation component supported on a porous base, specifically wherein the pore diameter of the catalyst ranges from between about 10 to 100 Angstroms, preferably between about 20 and 80 Angstroms, and most preferably between about 30 and 50 Angstroms, whereby the asphaltene agglomerates, including the majority of the metal-containing components in the initial hydrocarbon feedstock, do not have access to the catalyst surfaces thereof. Since these components are therefore not engaged in the catalytic desulfurization step, the problems of contamination and deactivation of the catalyst surfaces with these components is overcome, while at the same time hydrodesulfurization of the lower-boiling components, generally the 1050°F− components is accomplished therein. In this manner, between about 60 and 80 percent of the sulfur initially contained in these feedstocks or between about 80 and 99 percent of the sulfur in the 1050°F− components of the feed, is removed in the catalytic hydrodesulfurization step. The preferred catalysts comprise alumina, or alumina-containing materials having pore diameters of between about 10 and 100 Angstroms, preferably between about 20 and 80 Angstroms, and a surface area of between about 200 and 500 square meters/gram, as well as a pore volume of from about 0.2 to 0.5 cc/gram, impregnated or cogelled with a hydrogenation component or components. Generally, metals of Groups VIB and VIII, and most preferably, combinations thereof, are preferred as the metallic hydrogenation components.

Subsequent contacting with the alkali metal desulfurization agent, preferably sodium, is then conducted at elevated temperatures of greater than about 750°F, and in the presence of sufficient added hydrogen to maintain a hydrogen pressure of between about 1000 and 5000 psig therein, so that overall desulfurization of between about 50 and 95 percent of the initial sulfur content of the initial feedstocks employed are obtained, along with the hydroconversion, in said second stage, of between about 30 and 90 percent of the 1050°F+ components thereof.

In a preferred embodiment, the hydrogen sulfide generated in the initial catalytic hydrodesulfurization step is removed prior to the contacting with the alkali metal desulfurization agent, and the alkali metal sulfide salts produced during contact with the alkali metal hydrodesulfurization agent are contacted with hydrogen sulfide subsequent thereto, in order to produce alkali metal hydrosulfides, which are separated from the improved product stream, and from which alkali metal is then regenerated for recycling.

DETAILED DESCRIPTION

As described above, the present process is particularly effective with respect to the desulfurization of various heavy hydrocarbon fractions, particularly asphaltene-containing hydrocarbon fractions. The present process is thus particularly applicable and effective when employed for the desulfurization of such heavy hydrocarbons, for example, those containing residual oils. Preferably, therefore, the process disclosed herein may be employed for the combined hydrodesulfurization and hydroconversion of heavy hydrocarbon feedstocks containing from between about 2 to 30 percent asphaltenes, particularly the asphaltene fraction of petroleum residua characterized by a high molecular weight (generally from 1000 to 100,000) basically polycyclic aromatic structure, rich in sulfur, metals, and nitrogen. Specifically, such residua derived from various crude oil sources, such as Safaniya crudes from the Middle East, Laquinillas crudes from Venezuela, various U.S. crudes, etc. can be so treated. Specifically, both atmospheric residuum boiling above about 600°F, and vacuum residuum boiling above about 1000°F can be so treated. Preferably, the feedstock employed in the present invention is a sulfur-containing heavy hydrocarbon oil containing at least about 30 percent materials boiling above about 1050°F, and most preferably at least about 50 percent materials boiling above about 1050°F.

It is unnecessary to subject the feedstocks which are to be fed to the initial catalytic hydrodesulfurization step to various deasphalting processes, as has been done in the prior art. Since, however, various alkali metal salts will be produced during processing in connection with the alkali metal desulfurizing agent, in order to prevent sodium chloride contamination of these alkali metal salts therein, it is preferred to desalt the feed, preferably prior to the original catalytic hydrodesulfurization step. Such desalting is a well-known process in the refining industry, and may be generally carried out by the addition of small amounts of water to the feedstock to dissolve the salts, followed by the use of electrical coalescers. The oil may then be dehydrated by conventional means well known in this industry, prior to feeding into the initial catalytic hydrodesulfurization step.

As stated, the selective hydrodesulfurizing catalysts employed in this step include an alumina-containing porous base which is impregnated or cogelled with a hydrogenation component. Specifically, the alumina-containing porous base comprises alumina, or alumina in combination with a metal from Groups III, IV or V of the Periodic Table, such as boron, silicon, phosphorous, etc. Specifically, combinations of silica and alumina, alumina and aluminum phosphate, alumina and boria, etc., are most preferred. These porous bases are thus prepared by gelling or cogelling the base materials according to the teachings of U.S. Pat. Nos. 3,342,750 and 3,271,299, all of which is incorporated herein by reference hereto. It is most essential, however, that the particular porous base employed thus have pore diameters of between about 10 and 100 Angstroms, preferably between about 20 and 80 Angstroms, and most preferably between about 30 and 50 Angstroms, a surface area of from about 200 to 500 square meters/gram, and a pore volume of above about 0.2 cubic centimeters/gram, preferably from about 0.2 to 0.5 cubic centimeters/gram. These characteristics, and particularly the average pore diameter employed, thus assure that the higher boiling or asphaltene-containing agglomerates contained in the particular hydrocarbon feedstock employed will not have access to the active catalytic surfaces contained in these catalysts. These surfaces are thus prepared by impregnating or cogelling particular metallic hydrogenation components with these porous bases. Specifically, metallic hydrogenation components from Groups VIB and VIII of the Periodic Table of the Elements, including chromium, molybdenum and tungsten, from Group VIB, and nickel and cobalt, from Group VIII are preferred, and most preferably combinations of one such metal from Group VIB and one such metal from Group VIII. Generally, catalytic metals are incorporated at the time the base materials are gelled or cogelled, and catalyst pore size is regulated by the gellation media, e.g., water or water-alcohol mixtures, hydrogen ion concentration and drying procedure as set forth in U.S. Pat. Nos. 3,342,760 and 3,271,299 as discussed above.

The conditions in the initial catalytic hydrodesulfurization step are thus also selected in order to prevent the dissociation or conversion of the asphaltene agglomerates, including most of the metallic-containing materials in the feedstock. Specifically, temperatures of between about 550° and 800°F, preferably between about 700° and 750°F, are employed, in addition to pressures of from about 200 to 2000 psig, preferably from about 1200 to 1800 psig, and most preferably from about 800 to 1500 psig and flow rates of from about 0.2 to 5 V/V/Hr, preferably from about 0.5 to 1.0 V/V/Hr. It is therefore possible to at least partially desulfurize the asphaltene-containing feedstock, mostly by desulfurizing the lower-boiling components thereof, so that no more than about 70 percent desulfurization of the feedstock, preferably only about 60 percent and most preferably only from about 50 to 60 percent desulfurization is obtained therein. Again, this provides for little if any involvement of the asphaltenes in this catalytic desulfurization step. The hydrogen consumption in the catalytic hydrodesulfurization step is thus maintained at relatively low figures of from about 250 to 800 SCF/B, generally from about 400 to 600 SCF/B, and the catalyst life expectancy of such catalysts is maintained at high levels, such as those observed for the hydrodesulfurization of lighter feeds, such as vacuum gas oils, etc. Generally catalyst life of about one year is realized before regeneration is required. Regeneration of these catalysts may then be accomplished by procedures well known in the art.

By operating in the manner described above, the desulfurization which occurs in the catalytic desulfurization step thus results in the generation of hydrogen sulfide therein. Of necessity essentially all of the hydrogen sulfide is removed from the product obtained in the catalytic desulfurization step prior to additional desulfurization by contacting with the alkali metal desulfurizing agent. This is generally accomplished by purging the liquid stream of hydrogen sulfide by hydrogen stripping or flashing lighter products from the partially desulfurized liquid. The hydrogen sulfide thus removed may be employed subsequent to the contact with alkali metal desulfurizing agent in the manner described below.

The alkali metal desulfurizing agent may be an alkali metal such as sodium, potassium, rubidium, cesium, etc., however sodium is highly preferred for use therein. As is disclosed in the aforementioned concurrently filed applications, contacting of the alkali metal and sulfur-asphaltene containing feedstock is carried out at elevated temperatures and in the presence of added hydrogen in order that combined hydrodesulfurization and hydroconversion of the heavier feed components is obtained. Thus, temperatures above about 750°F, preferably above about 800°F, and most preferably between about 800° and 850°F, are employed, along with the addition of added hydrogen sufficient to maintain a hydrogen pressure of between about 1000 and 5000 psig, preferably from about 1000 to 3000 psig, and most preferably from about 1500 to 2500 psig in the conversion zone. In this manner, the bulk of the reactants within the reaction zone are maintained in a liquid phase, and the alkali metal is in a molten state. The alkali metal, such as sodium, reacts with the sulfur-containing oil in a manner to yield sodium sulfide, which generally forms as a micro-crystalline dispersion in the oil. This is acomplished as follows:

$$2Na + S\text{-oil} \quad Na_2S + \text{oil}$$

Additionally, the metals and nitrogen content of the feedstock is reduced by reaction with sodium, and the higher boiling, or 1050°F+ portion of the feedstock is both hydrodesulfurized and converted to lower-boiling products. Because of the prior removal of sulfur from the lower boiling components thereof, the relatively more expensive alkali metal employed, e.g., sodium, concentrates on the desulfurization of these asphaltene compounds, and a highly economical process evolves.

Contacting with the alkali metal desulfurization agent may be conducted as a batch or continuous type operation, but is preferably continuous. In general, the various means customarily employed in extraction processes to increase the contact area between the oil stock and the sodium metal therefore can be employed. Such apparatus are thus described at column 5, lines 8 ad seq of U.S. Pat. No. 3,788,978 which disclosure is incorporated herein by reference thereto.

The oil dispersion which is thus removed from the combined hydrodesulfurization and hydroconversion step in the presence of the alkali metal hydrodesulfurizing agent, thus containing alkali metal salts, predominantly alkali metal sulfide, therein, is then contacted with hydrogen sulfide in amounts ranging from about 100 to 400 mole percent, preferably 110 to 200 mole percent, based upon the total number of moles of salt present in the mixture. The net consequence of such $H_2S$ treatment is twofold: (1) At least a portion of the bi-product alkali metal salts, for example, such sodium salts as sodium oxide, sodium hydroxide and the like are converted to sodium hydrosulfide, and (2) Submicron salts are agglomerated to yield a macrocrystalline salt phase (preferably having a particle size between about 150 to 200 microns) which readily disengages from the oil phase. The salt phase is separated from the oil phase and recovered employing one of several well-known commercial techniques, notably filtration or centrifugation. The $H_2S$-treated mixture of salts is then treated in various ways in order to regenerate alkali metal therefrom. Specifically, as is fully discussed in U.S. Pat. No. 3,788,978, beginning at column 3 thereof, alkali metal polysulfides may be produced from the alkali metal hydrosulfides, and finally subjected to electrolysis for the generation of alkali metal therefrom. Again, this portion of U.S. Pat. No. 3,788,978 dealing with the specific techniques employed for both preparing the alkali metal polysulfides and the electrolysis thereof, including the details regarding the electrolytic cell unit employed, are incorporated herein by reference thereto. Alternatively, the compound of sodium may be reacted with steam and carbon dioxide to release hydrogen sulfide, which may then be recycled, and sodium carbonate thermally reduced in the presence of coke in order to regenerate sodium for recycling, as is well known in the art.

DESCRIPTION OF THE DRAWING

The drawing is a schematic flow diagram of the process of the present invention, including regeneration of alkali metal by electrolysis.

Referring to the drawing there is shown an integrated process for treating a sulfur and asphaltene-containing hydrocarbon feedstock first with the selective hydrodesulfurization catalyst and subsequently with an alkali metal desulfurizing agent. Thus, an asphaltene-containing hydrocarbon feedstock such as a residuum feedstock, preferably preheated to a temperature of between about 600° and 850°F, is fed into a hydrodesulfurization zone 2 through line 4. Preferably, this feedstock will initially be fed into a separator vessel for the removal of trace amounts of water and light hydrocarbon fractions therefrom, all of which is conventional, and is also disclosed in U.S. Pat. No. 3,787,315 which is incorporated herein by reference thereto. Thus, the feed may also, prior to entry into the hydrodesulfurization zone 2, be pumped into a filter vessel for the removal of particulate matter, such as coke, scale, etc., and/or be preliminarily desalted by conventional means not shown in the FIGURE.

The hydrodesulfurization zone 2 may be either a fixed, slurry or a conventional ebulating type reactor, preferably fixed bed, in which the residuum feedstock may be contacted with the aforedescribed catalyst.

The hydrodesulfurization zone 2 is itself maintained at a temperature of from about 550° to 800°F, a pressure of from about 200 to 2000 psig, and a space velocity of from about 0.2 to 5.0 V/V/Hr. Hydrogen is thus also fed into the hydrodesulfurization zone 2 through line 6, and recycle hydrogen through line 8 as discussed below. As for this hydrogen stream itself, it can be introduced into the hydrodesulfurization zone 2 either as pure hydrogen, as for example that from a steam reforming process, or as diluted hydrogen gas streams, such as discarded refinery streams produced in hydrotreating processes, etc. Again, a hydrogen pressure of between 200 and 2000 psig is maintained in the hydrodesulfurization zone 2. A partially desulfurized oil, along with hydrogen and hydrogen sulfide generated in the hydrodesulfurization zone 2, are withdrawn through line 10 therefrom. For the reasons stated above, the partially desulfurized oil removed through line 10 will still include most of the asphaltenes, nitrogen and/or metal-containing components, and will have a sulfur content reduced by only about 50 percent mostly through the hydrodesulfurization of the lower-boiling components thereof. This stream then enters a purge vessel 12 for the displacement of the hydrogen sulfide therefrom. This vessel, which is conventional, includes means for the injection of added hydrogen through line 14, so that hydrogen sulfide is removed therefrom through line 16. The purge vessel 12 is thus maintained at a temperature of greater than about 500°F, and a pressure of about 200 to 2000 psig, with the resultant partially desulfurized oil-hydrogen mixture being fed into a conversion zone 18 for contact with the alkali metal desulfurization agent.

As for contact of the alkali metal and the partially desulfurized oil in the conversion zone 18, the oil is fed into the conversion zone 18 through line 20, while the alkali metal is fed into the conversion zone 18 through line 22. Intimate contacting is accomplished by the direct injection or spraying of the alkali metal into the conversion zone 18 in the molten state. This zone 18 itself is maintained at the conditions described above including similarly high pressures. The reaction zone 18 may itself include baffles to promote the continuous contacting of the alkali metal and the oil, to prevent bypassing directly from the inlet of the reactor to the outlet, all of which is conventional. Further it is noted, hydrogen enters reaction zone 18 along with the feed through line 20, and sufficient hydrogen is added thereto in the purge vessel 12 through line 14 in order to maintain a hydrogen pressure within the reaction zone 18 of at least about 1500 psig, and preferably from about 1500 to 2500 psig, as described above. Holding times in the reaction zone 18 of between 15 to 120 minutes are preferred, preferably of about 30 to 60 minutes, and the temperature conditions as described above are maintained therein. The temperature at the top of reaction vessel 18 will thus be about 850° to 875°F, and any gases formed within the reactor 18 may be withdrawn overhead through line 24 for condensation and depressurization by conventional means. The desulfurized and hydroconverted products, containing dispersed alkali metal sulfides, which are produced in the reaction vessel 18, may then be withdrawn from the reactor 18 through line 26. This dispersion will thus be at a temperature above about 800°F, and at between about 1500 and 2500 psig, and may be subsequently cooled and depressurized prior to subsequent separation of the sulfur-bearing salts. In this manner, hydrogen and light hydrocarbons are removed from the stream and, after appropriate further condensation and separation, hydrogen is recycled to zone 2 and hydrocarbon products are forwarded to storage. In addition, however, hydrogen sulfide is then added to this product stream through line 16, preferably utilizing the hydrogen sulfide generated in the reactor 2 and removed in the purge vessel 12. Again, the details of contacting of the oil product and hydrogen sulfide are contained in U.S. Pat. No. 3,788,978 all of which is again incorporated herein by reference thereto, in order to convert the alkali metal salts therein to the alkali metal hydrosulfides, for easier separation. This contacting may thus be carried out in a contacting vessel, wherein the dispersion of oil and alkali metal salts are contacted with from about 110 to 400 mole percent hydrogen sulfide based on the total moles of salt contained in the oil, at a temperature between about 600° and 800°F, and preferably 680° to 750°F. The pressure is maintained between about 300 and 1000 psig, and the residence time in the contactor vessel will be in the order of about 10 minutes, although longer or shorter times may be used if desired.

The $H_2S$-treated dispersion in line 26 is then cooled to about 680°F, in a heat exchanger, and the mixture is then fed to a separator vessel 27. This separator may itself include hydrocyclone vessels, as shown in U.S. Pat. No. 3,788,978 or other such means. The highly desulfurized and upgraded oil is withdrawn through line 28 for subsequent feeding to a heat exchanger so that it exits at a temperature of 250° to 300°F.

In the embodiment shown in the drawing, alkali metal hydrosulfide salt phase is withdrawn from separator 27 through line 29 for subsequent treatment in electrolytic cell 30. Thus, the molten alkali metal hydrosulfides may then be fed to a polysulfide blending vessel for contact with sulfur or sulfur rich polysulfide from which a molten sulfur depleted alkali metal polysulfide is formed preferably represented by the formula $M_2S_Y$, where M represents an alkali metal, preferably sodium, and varies from between about 3.0 to 4.3 and preferably from about 3.8 to 4.0. The resultant sulfur-depleted alkali metal polysulfide can be electrolyzed in an electrolytic cell 30 wherein the cathode and anode compartments are separated by an alkali metal ion permeable membrane 31, preferably beta-alumina as described in U.S. Pat. Nos. 3,787,315 and 3,788,978, all of which is also incorporated herein by reference thereto. Alkali metal produced in the cathode compartment is withdrawn through line 22 for recycling. Sulfur rich alkali metal polysulfide produced at the anode is withdrawn via line 32 and used in part to blend with the alkali metal hydrosulfide as noted above. Further, part of the sulfur rich polysulfide is partially pyrolyzed to recovery elemental sulfur from the process.

The electrolytic cell 30 may itself comprise any such cell capable of converting the hydrosulfide or polysulfide to the alkali metal, and is preferably blanketed by dry nitrogen stream. Again, the preferred unit comprises a molten alkali metal-containing cavity separated from each other by an alkali metal ion-permeable membrane preferably comprising crystalline beta-alumina, also as discussed in U.S. Pat. No. 3,788,978, which portion thereof is incorporated herein by reference thereto.

PREFERRED EMBODIMENTS

The present process may be further understood by reference to the following example thereof.

EXAMPLE 1

A Safaniya atmospheric residuum feedstock having the composition shown in Table I, including an asphaltene content of 11.5 percent was subjected to the combined desulfurization and conversion of the present invention. Initially, this feed was contacted with a hydrodesulfurization catalyst comprising 3.5% cobalt and 12.0% molybdenum oxides cogelled with a porous base comprising aluminum phosphate and alumina, and having an average pore diameter of about 50 Angstroms. This step was conducted at the conditions, and with the results, shown in Column A of Table II. Subsequently, after purging of $H_2S$, the products from this step were contacted with 2.8% sodium on feed in a conversion zone maintained at the conditions, and with the results shown in Column B of Table II.

These results clearly demonstrate the significant results obtainable by employing the present process, including an overall reduction of the 1050°F+ portion of the feedstock of 80 percent, almost quantitative demetallization, an overall sulfur reduction of almost 99 percent, and significant nitrogen and asphaltene removal.

TABLE I

FEEDSTOCK INSPECTION OF SAFANIYA ATMOSPHERIC RESIDUUM EMPLOYED IN EXAMPLE 1

| | |
|---|---|
| API Gravity | 14.5 |
| Sulfur | 4.0 |
| Nitrogen, Wt. % | 0.3 |
| Conradson Carbon, Wt. % | 12.0 |
| Asphaltenes | 11.5 |
| C/H Wt. Ratio | 7.7 |
| Metals, ppm | |
| Ni | 22 |
| V | 78 |
| Fe | 4 |
| Vol. % 1050°F− | 59 |
| Vol. % 1050°F+ | 41 |
| Distillation | |
| IBP, °F | 464 |
| 5% | 569 |
| 10% | 632 |
| 20% | 724 |
| 30% | 806 |
| 40% | 883 |
| 50% | 962 |
| 60% | 1035 |
| 70% | — |
| 80% | — |
| 90% | — |
| 95% | — |
| FBP | 1035 |
| % Rec. | 59.2 |
| % Res. | 40.8 |

TABLE II

COMBINED HYDRODESULFURIZATION AND HYDROCONVERSION OF SAFANIYA ATMOSPHERIC RESIDUUM FEEDSTOCK

| | Column A | Column B |
|---|---|---|
| Conditions | | |
| Temperature, °F. | 700 | 825 |
| Pressure, psig. | 1500 | 1750 |
| $H_2$ rate, SCF/Hr. | 4000 | 4000 |
| Feed Rate, V/V/Hr. | 1.0 | — |
| Contact Time, Hrs. | — | 1.0 |
| Sodium Rate, lbs/B | — | 10 |
| ($H_2$ Consumed, SCF/B) | 330 | 380 |
| Product, Wt. % | | |
| $C_5$-Gas | <2% | 3.7 |
| Coke | nil | 1.8 |
| Liquid | 98 | 92.4* |
| Liquid Inspections | | |
| Sulfur, Wt. % | 1.8 | 0.1 |
| Conradson Carbon, Wt. % | 8.4 | 3.0 |
| Nitrogen, Wt. % | 0.2 | 0.1 |
| Asphaltenes, Wt. % | 11.1 | — |
| Ni/V/Fe, ppm | 23/79/2 | 1 ppm, all |
| API Gravity | 21.8 | 31.5 |
| C/H Wt. Ratio | 7.25 | 7.0 |
| Vol. % 1050°F− | 65 (est.) | 92 |
| Vol. % 1050°F+ | 35 (est.) | 8 |

*100 Vol. % on feed overall

What is claimed is:

1. A process for the combined desulfurization and conversion of a sulfur- and asphaltene-containing feedstock which comprises a. contacting said feedstock with a desulfurization catalyst comprising at least one metallic hydrogenation component selected from the metals consisting of Group VIB and Group VIII of the Periodic Table supported on a porous base, said porous base having a pore diameter ranging from between about 10 to 100 Angstroms, under hydrodesulfurization conditions, so that said feedstock is at least partially desulfurized, and further so that hydrogen sulfide is generated therein; and b. contacting said at least partially desulfurized feedstock from step (a) with an alkali metal in a conversion zone, at elevated temperatures, and in the presence of added hydrogen, so that at least 50 percent of the sulfur content of said feedstock is removed therefrom, and further so that at least about 50 percent of the heavy bottoms fraction of said at least partially desulfurized feedstock, boiling above about 1050°F, is converted to lower-boiling products and c. withdrawing said lower-boiling products and desulfurized feedstock from step (b).

2. The process of claim 1 wherein said porous base comprises an alumina-containing gel.

3. The process of claim 1 wherein said hydrodesulfurization catalyst includes at least two hydrogenation components, including a metal from Group VI of the Periodic Table and a metal from Group VIII of the Periodic Table, and further wherein said porous support comprises a porous support selected from the group consisting of alumina, aluminum phosphate-alumina, alumina-boria and mixtures thereof.

4. The process of claim 1 wherein said alkali metal comprises sodium.

5. The process of claim 1 wherein said hydrodesulfurization conditions include a temperature of between about 550° and 800°F, a hydrogen pressure of between about 200 and 2000 psig, and a liquid hourly space velocity of between about 0.2 and 5.0 V/V/Hr.

6. The process of claim 1 wherein said elevated temperature is greater than about 750°F.

7. The process of claim 1 wherein sufficient hydrogen is added to said conversion zone to maintain a hydrogen pressure of between about 1000 and 5000 psig.

8. The process of claim 1 wherein said contacting of said at least partially desulfurized feedstock with said alkali metal in said conversion zone results in the generation of alkali metal sulfide, and wherein said alkali metal sulfide is contacted with hydrogen sulfide, in order to convert said alkali metal sulfide into the corresponding alkali metal hydrosulfide.

9. The process of claim 1 wherein said feedstock comprises a residuum feedstock including about 30% asphaltenes.

10. A process for the combined hydrodesulfurization and hydroconversion of a sulfur- and asphaltene-containing feedstock, said feedstock including more than about 30% asphaltenes, which comprises a. contacting said feedstock with a hydrodesulfurization catalyst comprising a hydrogenation component selected from the metals of Group VIII of the Periodic Table, a hydrogenation component selected from the metals of Group VIB of the Periodic Table, and a porous alumina-containing support, said hydrodesulfurization catalyst having a pore diameter ranging from between about 20 to 80 Angstroms, under hydrodesulfurization conditions including a temperature of between about 550° and 850°F, and a hydrogen pressure of from 200 to 2000 psig, so that at least 40 percent of the sulfur contained in said feedstock is removed therefrom, and b. contacting said at least partially desulfurized feedstock from step (a) with an alkali metal in a conversion zone, said conversion zone being maintained at a temperature above about 750°F, and in the presence of added hydrogen sufficient to maintain said conversion zone at a pressure of from 1000 to 5000 psig, so that at least 50 percent of the heavy feed components boiling above 1050°F in said at least partially desulfurized feedstock are converted to lower-boiling products, and further so that at least 50 percent of the sulfur content of said feedstock is removed therefrom, with the resultant formation of alkali metal sulfide in said conversion zone, and c. withdrawing said lower-boiling products and desulfurized feedstock from step (b).

11. The process of claim 10 wherein said hydrodesulfurization catalyst comprises a Group VI metal selected from the group consisting of cobalt, molybdenum, and tungsten, and said Group VIII metal comprises a metal selected from the group consisting of nickel and cobalt, and where said alumina-containing porous support comprises a porous support selected from the group consisting of alumina, silica-alumina, aluminum phosphate-alumina, boria-alumina, and mixtures thereof.

12. The process of claim 10 wherein the hydrogen sulfide generated in said hydrodesulfurization zone is removed from said at least partially desulfurized feedstock prior to contacting said at least partially desulfurized feedstock with said alkali metal.

13. The process of claim 10 wherein said hydrogen sulfide is stripped from said partially desulfurized feedstock by contacting said at least partially desulfurized hydrocarbon feedstock with added hydrogen.

14. The process of claim 10 wherein said lower-boiling products and the desulfurized feedstock withdrawn from said conversion zone are contacted with hydrogen sulfide in order to convert said alkali metal sulfides to the corresponding alkali metal hydrosulfides.

15. The process of claim 10 wherein said hydrogen sulfide separated from said at least partially desulfurized hydrocarbon feedstock from step (a) is contacted with said lower-boiling products and the desulfurized feedstock withdrawn from said conversion zone.

16. The process of claim 10 wherein said alkali metal hydrosulfides are separated from the said lower-boiling products and the desulfurized feedstock withdrawn from said conversion zone.

17. The process of claim 16 wherein alkali metal is regenerated from said alkali metal hydrosulfides.

18. The process of claim 17 wherein said alkali metal is regenerated by the electrolysis of said alkali metal hydrosulfides.

19. The process of claim 16 wherein said alkali metal comprises sodium, and said sodium is regenerated by contacting said sodium hydrosulfides with steam and carbon dioxide so that sodium carbonate is produced therein, and further wherein sodium carbonate is thermally reduced in the presence of coke, to produce said sodium therefrom.

* * * * *